United States Patent [19]

Kurina et al.

[11] 4,447,816

[45] May 8, 1984

[54] STIFFENING CLAMP FOR SELF-ERECTING ANTENNA

[75] Inventors: Miles J. Kurina, Wellesley Hills; John Thornhill, Tewksbury, both of Mass.

[73] Assignee: RCA Corporation, New York, N.Y.

[21] Appl. No.: 325,046

[22] Filed: Nov. 25, 1981

[51] Int. Cl.[3] ..... H01Q 1/08

[52] U.S. Cl. ..... 343/877; 242/54 A; 52/108

[58] Field of Search ..... 343/877, 883, 900, 901; 52/108, 110; 242/54 R, 54 A

[56] References Cited

U.S. PATENT DOCUMENTS

| | | | |
|---|---|---|---|
| 3,268,903 | 8/1966 | Kuecken et al. | 343/791 |
| 3,364,488 | 1/1968 | Perenic et al. | 343/723 |
| 3,410,615 | 11/1968 | Bieber | 308/6 |
| 3,448,939 | 6/1969 | Bieber | 242/54 |
| 3,467,328 | 9/1969 | Berry et al. | 52/108 |
| 3,467,329 | 9/1969 | Giltner | 242/54 |
| 3,541,568 | 11/1970 | Lowenhar | 343/877 |
| 3,737,912 | 6/1973 | Cribb | 343/880 |
| 4,117,495 | 9/1978 | Hochstein | 343/877 |
| 4,151,534 | 4/1979 | Bond | 343/883 |
| 4,225,871 | 9/1980 | Ramari | 343/877 |

OTHER PUBLICATIONS

"STEM Design and Performance," Astro Research Corp.

*Primary Examiner*—Eli Lieberman
*Assistant Examiner*—Michael C. Wimer
*Attorney, Agent, or Firm*—Joseph S. Tripoli; Robert L. Troike; William Squire

[57] ABSTRACT

A flattened resilient sheet metal band prestressed to assume the shape of an extended tubular rod when unstressed, is stored as a coil wound on a spool. The end of the band is fixed to a post. When the coil is released, the band assumes its tubular shape and the end of the band fixed to the post encircles the post. A clamp responsive to the change in shape of end of the band clamps it to the post when the band assumes its tubular rod shape.

10 Claims, 8 Drawing Figures

STIFFENING CLAMP FOR SELF-ERECTING ANTENNA

The present invention relates to self-erecting antennas and to structures for supporting such antennas.

Self-erecting antennas of the type known as "STEMs" (storable tubular extendable member) include a tape formed of thin resilient sheet metal which in the stored condition is in the shape of a flat spiral coil wound about a drum or spool and which extends by unwinding into a strip which then assumes the shape of a tube with the tube axis perpendicular to the axis of the stored coil. Such antennas and their characteristics are described in a paper "STEM Design and Performance" by Astro Research Corp.

The diameter of the drum or spool on which the coil is stored is chosen such that the elastic limit of the tape material is not exceeded when coiled. The length of tape always tends to assume its extended tubular form, when the coil is unstressed and unrestrained. The STEM is substantially free of stress in its natural, extended form which comprises a straight overlapped tube of uniform diameter. Materials with a relatively high ratio of yield strength to modulus of elasticity E can be employed for STEMs, common materials in use being beryllium copper and stainless steel. The smallest tube diameter which is possible for a STEM, for a given tape material thickness, without causing permanent deformation of the tape, can be determined as discussed in the article.

A STEM antenna can be manufactured in a number of different configurations. In one configuration a single tape is prestressed to assume a tube that has an approximate circular section in which the edges of the material overlap by approximately 160°. This provides a tubular element with a bending strength and stiffness almost equivalent to a seamless tube of about the same diameter and thickness.

The above-described overlapped STEM is manufactured, in one form, with a motor drive which extends the tape material from the drum. It is also available in a self-erecting form. A self-erecting STEM is one in which an end of the tape material that is wound as a coil is secured to a relatively short cylindrical post of circular cross-section forming a relatively short cylinder. The coiled tape is stored in fixed space relationship with respect to the post. When the coil is released from its constrained position, due to the stored strain energy, it automatically unwinds in a direction away from the post and assumes the shape of tubular antenna which is secured to the post at one end.

The latter configuration, however, has certain limitations. While it has the advantage of not requiring external power to extend the antenna from the stored coil configuration, long antennas such as 8 feet or longer, tend to bend in response to certain wind loads normal to the long axis of the antenna. While it is desirable to strengthen such an antenna, known reinforcements which comprise ring-like devices such as shown in U.S. Pat. No. 3,467,329 and other devices such as shown in U.S. Pat. No. 3,410,615 are suitable primarily for power-driven antennas. A self-erecting antenna changes shape from a spiral coil to an extended rod-like antenna element while it remains secured to a support at one end. The spool about which the flattened antenna tape material is wound is at the free end of the tape during erection of the tape, that is, it remains with the antenna tape material as it uncoils. When the antenna is fully erected, the spool is released. The ring and bearing reinforcing techniques described in the patents above are not readily applicable to this kind of antenna as the coil and spool cannot pass through the opening of the ring or bearing devices.

In a self-erecting antenna embodying the present invention, a sheet metal band is prestressed to assume an extended tubular rod when unstressed and is sufficiently resilient to be flattened and spirally wound into a coil, the combination therewith includes means for releasably securing the band in the coil state and movable clamp means including means responsive to the change in shape of the band for clasping and securing the tubular band after the band assumes its tubular state.

Figure 7:
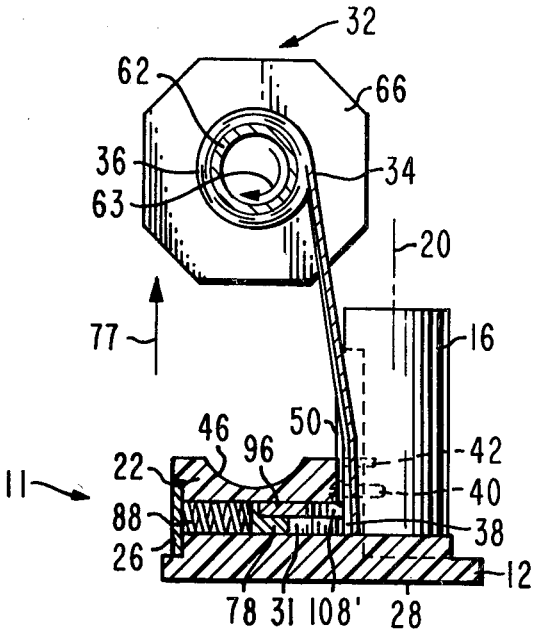
Figure 8:
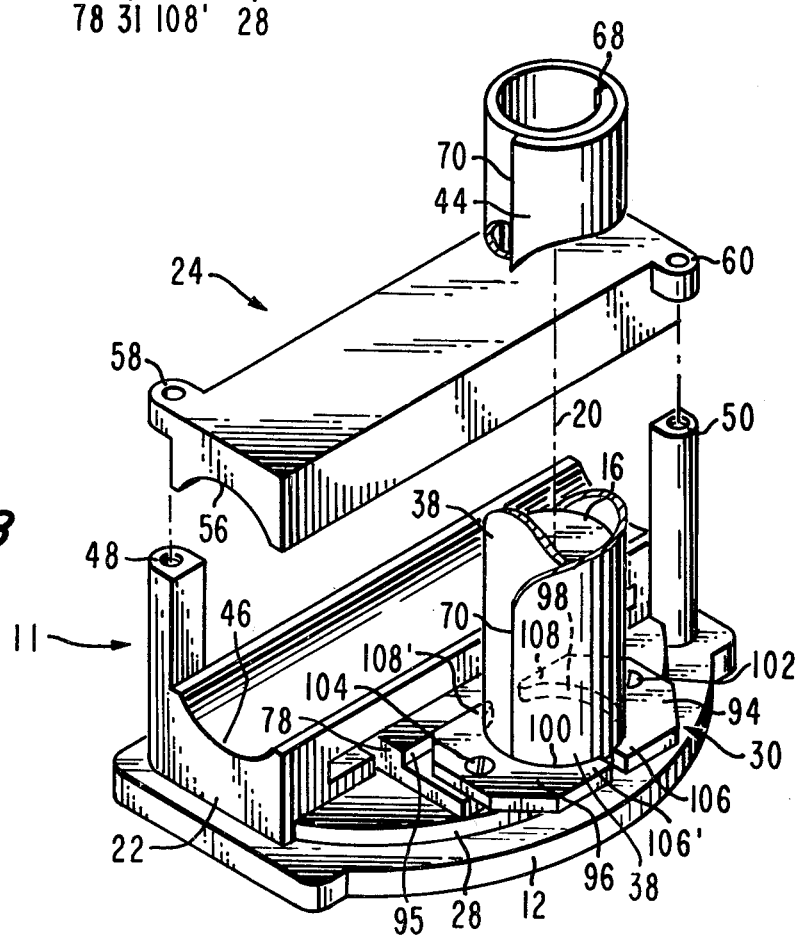

FIG. 7 is a sectional view of an embodiment of the present invention illustrating an intermediate stage of operation of the antenna from a coiled position to its extended position; and FIG. 8 is an isometric view of an embodiment of the present invention with the antenna extended showing, in a partially exploded view, the antenna restraining device for restraining the antenna in the flattened coiled condition.

Figure 1:
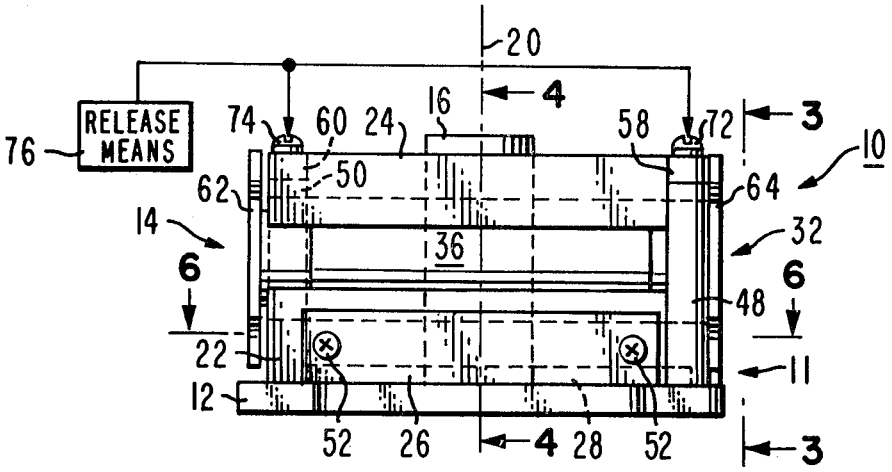
FIG. 1 is a front elevation and partially diagrammatic view of an embodiment of the present invention.

In FIG. 1, self-erecting antenna structure 10 includes a coiled antenna assembly 14. The assembly 14 comprises coiled antenna 36, (FIG. 4), lower saddle structure 11, upper saddle 24, a post 16, and a front cover 26. Saddle structure 11 includes a lower saddle 22, a base 12, a platform 28, and two upright stanchions 48 and 50, all of which may be formed of plastic material such as nylon and may be molded as an integral structure. Coiled STEM antenna 36 is stored between saddles 22 and 24, FIG. 4. The lower saddle 22 has a cavity 31 within which the antenna clamp assembly 30 is secured in place by cover 26.

Figure 3:
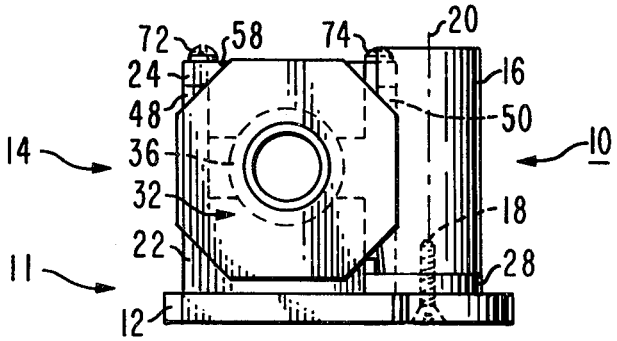
FIG. 3 is an end elevation view of the embodiment of FIG. 1 taken along lines 3—3.

The post 16 is a circular rigid cylinder which may be made of metal or other material secured to platform 28 by a fastening device such as screw 18, FIG. 3. Post 16 has a longitudinal axis 20 which is normal to the platform 28 and base 12 and to the coil axis about which antenna 36 is coiled. The deployable antenna to be described, when extended, wraps about post 16 at one end and extends along axis 20. The post is relatively short with respect to the antenna length and may be, for example, a few inches as compared to several feet for the antenna.

Figure 2:
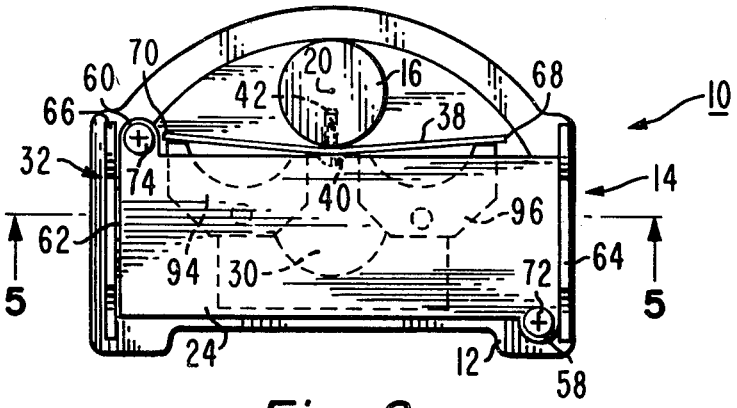
FIG. 2 is a plan view of the embodiment of FIG. 1.
Figure 4:
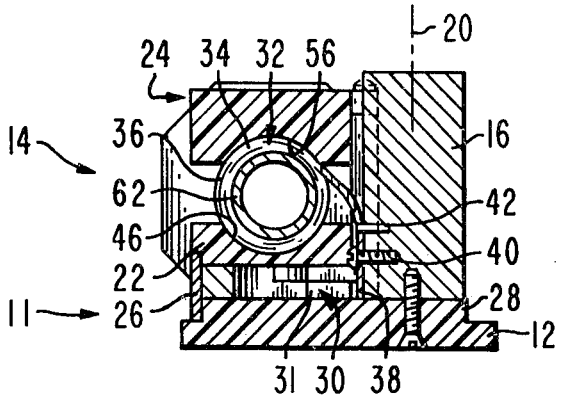
FIG. 4 is a side elevation sectional view of the embodiment of FIG. 1 taken along lines 4—4.
Figure 5:
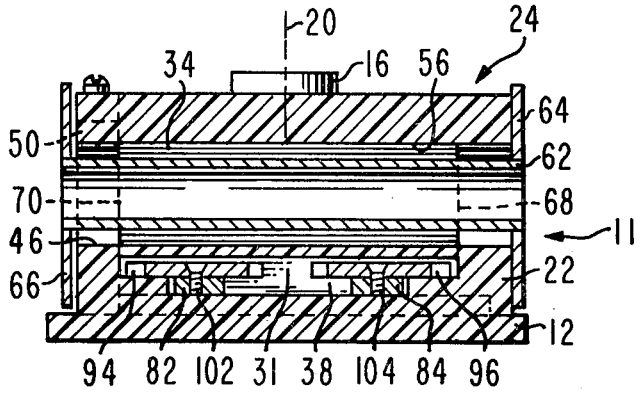
FIG. 5 is a front elevation sectional view of the embodiment of FIG. 2 taken along lines 5—5.

The antenna 36, FIG. 4, comprises a prestressed, flexible sheet spring metal band or tape 34 coiled about hollow drum 62 of spool 32, spool 32 including drum 62 and two end plates 64, 66, FIG. 2. Tape 34, FIG. 4, and its corresponding spool 32, are known and are commercially available. Therefore, the details of the tape 34 and spool 32 need not be given herein. Tape 34 extends into a tubular antenna, as will be described, when in the unstressed state. Tape 34 is prestressed so that, when released, it assumes a tubular shape in which the edges 68, 70, FIGS. 2 and 5 of the material overlap forming, in one embodiment, an elongated tubular rod 44 as shown in FIG. 8. The rod 44 is generally circular in section transverse to its longitudinal axis 20 but actually is in the form of a spiral. The tape 34 shown in the form of an overlapped tube in FIG. 8 is sufficiently resilient that it may be flattened and the flattened tape wound upon itself to form coil as shown by 36, FIG. 4, having an axis normal to the long axis 20 of the tube.

When in the coiled state, FIG. 4, the end 38 of tape 34 is substantially in the flattened state, and is fastened by screw 40 to the post 16. A straight pin 42 above the screw 40 secured to the post and passing through an aperture in the tape 34 aligns the tape 34 so that the long axis of the antenna, when it assumes the tubular configuration, coincides with the axis 20 of the post 16. The tubular rod 44, FIG. 8, may be 8 feet in length and have an outside diameter of about ¾ inch. The rod 44 may bend and fail at post 16 when exposed to winds 35 m.p.h. or greater whose forces torque the rod with respect to post 16. Clamp assembly 30, FIG. 6, includes jaws 94, 96, to be described, which automatically support the rod at post 16 as soon as the rod is formed, as shown in FIG. 8, alleviating that bending problem.

In FIG. 8, lower saddle 22 has a semi-circular trough 46 which extends in a direction generally normal to and spaced from the axis 20 of the extended rod 44. The saddle 24 is secured to the stanchions 48 and 50. Cover 26, FIG. 1, is fastened to the lower saddle 22 via screws 52.

Upper saddle 24, FIG. 8, comprises a block having a semi-cylindrical circular trough 56 which is a mirror image of trough 46 of lower saddle 22. The upper saddle has two ears 58 and 60 which are secured by respective pyrotechnic devices 72 and 74 (FIG. 1) to the respective stanchions 48 and 50. The troughs 46 and 56 of the respective lower and upper saddles form a circular cylindrical cavity when the upper saddle is secured in place, FIG. 4.

The coiled antenna 36 wound about spool 32, is placed in the cylindrical cavity formed by the upper and lower saddles 24 and 22, FIG. 4. The saddles 22, 24 constrain the tape 34 in the coiled configuration.

In FIG. 4, end 38 of the coil 36 terminates adjacent clamp assembly 30 to the right of cavity 31 in the drawing. Because the tape 34 of the coil 36 is flattened adjacent end 38, the end 38 is also strained in the flattened state, FIG. 2. In FIG. 2, the end 38 is bowed somewhat with respect to the post 16 due to forces exerted by the abutting clamp assembly 30 jaws 94, 96. In this orientation, edge 68 of end 38 is adjacent the end plate 64 and opposite edge 70 is adjacent to end plate 66.

In FIG. 1, pyrotechnic devices 72 and 74 are coupled to release means 76. Means 76 include suitable timing and firing circuits for exploding and thus releasing the devices 72 and 74 at the desired time. The devices 72 and 74 and release means 76 are known and need not be described in detail herein. Upon firing of the devices 72 and 74, they disengage from stanchions 48 and 50, thereby releasing upper saddle 24 from lower saddle 22.

At this point, the coiled antenna 36 is under prestress as described previously. The natural tendency of the internal stresses of the antenna coil is to unwind the coil and cause the coil to assume the tubular rod configuration of rod 44, FIG. 8. The coil when released by the release devices 72, 74, catapults out of the trough 46 of the lower saddle 22 as shown in FIG. 7, flinging the released upper saddle 24 aside. The coil tends to move away from the post 16 in direction 77 generally parallel to the post axis 20.

In FIG. 7, the upper saddle has been cast away. The coiled antenna automatically unwinds and, wraps itself around post 16 in the process, forming the extended tubular rod 44, FIG. 8. Spool 32 remains with the coil 36 as it unwinds. After the coil unwinds sufficiently the end 38 of the tape 34 wraps itself completely around the post 16 with its opposite edges 68, 70 overlapping as shown in FIG. 8. The post is at the base of the rod. The spool 32, on the other hand, falls away from the free end of the tubular rod when the coil unwinds sufficiently.

The tape 34 is prestressed in a manner such that the overlap of the tape material adjacent edges 68, 70 is the same throughout the length of the rod commencing at the lower end 38, FIG. 8, to and including the opposite free end. The rod 44, thus formed, is a straight tube of uniform cross-section.

Figure 6:
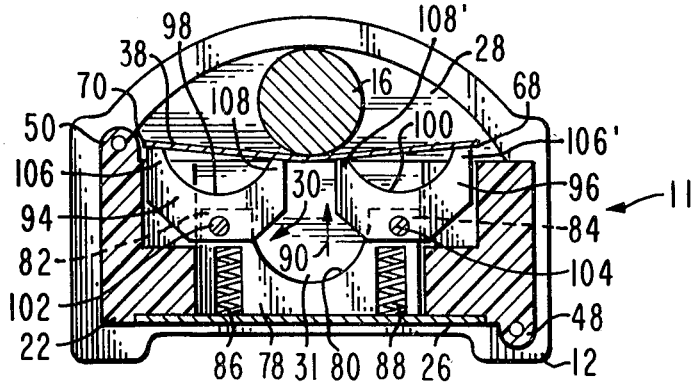
FIG. 6 is a plan sectional view of the embodiment of FIG. 1 taken along lines 6—6.

Clamp assembly 30, FIGS. 6 and 8, tends to prevent failure of the rod 44 in the presence of wind loads normal to axis 20, the failure having been found to be due to the relative weakness of the tube at the base 38 of the rod, that is, at the overlapping positions of the rod adjacent edges 68, 70 at the base. This weakness is attributable to the opening or flexing of the overlapping tube material adjacent the edges 68, 70 in the presence of the wind loads which torque the rod 44 about post 16. Clamp assembly 30 clamps the rod 44, end 38, to the post 16, surrounding the rod 44 for most of the periphery of the rod. This action precludes the opening of the rod edges 68, 70 at end 38 or other buckling of the tape 34 in the presence of bending torques and thus, alleviates the possible bending failure of the rod.

Clamp assembly 30 comprises a yoke 78 in the lower saddle 22 cavity 31, as shown in FIG. 6. The yoke 78 has a circular edge surface 80 and two ears 82 and 84. Two compression coil springs 86 and 88 are located in recesses in the yoke 78. The springs abut at one end the respective ears 82 and 84 and at the other end cover 26. The springs 86 and 88 resiliently continuously bias or urge the yoke 78 in direction 90 toward the post 16. When yoke 78 moves in direction 90, the edge surface 80 is adjacent end 38 of the wound tape 34.

Pivotally secured to ears 82, 84 are respective clamp jaws 94, 96. The jaws 94 and 96 are mirror images of each other. The jaw 94 has a concave curved surface 98 which may be circular and identical to concave curved surface 100 in jaw 96. Surfaces 98 and 100 are dimensioned so as to encircle and abut rod 44, FIG. 8, in the clamp mode. Jaw 94 is pinned to ear 82 by pivot pin 102, which may be a screw, FIG. 6. Jaw 96 is pinned to ear 84 by pin 104 which may also be a screw. The jaws freely rotate about their respective pins.

The jaw 94, curved surface 98, forms a pair of teeth 106 and 108. Similar teeth 108' and 106' are formed by jaw 96. The pins 104 and 102 are located along respective radial lines passing through axis 20 at the center of the post 16. The radial lines may be at equal angles with a line passing through axis 20 parallel to direction 90. The teeth 108, 108' are so positioned with respect to post 16 that when urged in direction 90 by yoke 78 via pins 102 and 104, they abut antenna tape 34, end 38, when end 38 is flattened as shown in FIG. 6 or tubular as shown in FIG. 8. When yoke 78 moves in direction 90, teeth 106 and 106' move in direction 90 spaced from the post 16.

In operation, when the tubular rod is formed and the end of the rod wraps around post 16, the springs 86 and 88 start moving the yoke 78 toward the post. After a short distance, teeth 108 and 108' are prevented from further movement by engagement with portions of the tape which now abut the post 16. The yoke 78, however, continues to move and the jaws now pivot about the points on the tape engaged by the teeth 108 and 108'. During such pivoting motion, jaw 96 rotates counterclockwise about pin 104 (as viewed in FIG. 6) and jaw 94 rotates clockwise about pin 102. This rotation continues until both jaws fully engage the end of the tube as shown in FIG. 8.

The orientation of the jaws 94, 96, FIG. 8, when engaged with rod 44 in their extended position, is about 90° from that of the orientation of the jaws, FIG. 6, when disengaged in the retracted position. Any attempt to open the jaws at this time by bending forces on the rod is precluded by the counter torque produced by springs 86, 88 and by the mechanical advantage presented by the location of the pins 102 and 104 and their spaced relationship from teeth 108 and 108' at the locations where these teeth abut end 38. Also, forces on the teeth 108, 108' in a direction tending to rotate jaw 96 counterclockwise as viewed in FIG. 8 and jaw 94 clockwise are resisted by the spaced relationship of yoke 78, shoulder 95, with respective jaws 96 and 94. The mechanical advantages for this structure can be ascertained by viewing the assembly in the clamp mode in plan view and laying out the forces in different directions and determining the resulting torques with respect to pins 102 and 104, and teeth 106, 106', 108 and 108'. Further, a ratchet and pivot mechanism (not shown) may be employed for locking the jaws in their extended position as shown in FIG. 8. In any case, the spring design is such that the counter torque is sufficient to hold the tube in place against the post for the bending forces anticipated.

In the disengaged or disabled state, when the clamp is positioned as shown in FIG. 6, and the antenna is positioned as shown in FIG. 4, the clamp assembly 30 is held in position, FIG. 6, by the flattened end 38 of the tape 34. As described previously, the end 38 is generally sufficiently flattened and sufficiently stiff such that the tape 34, edges 68, 70, FIG. 6, extend beyond the jaws 106 and 106' of the clamp assembly 30 and resist significant bending by the jaws. In this configuration, the jaws 106, 108; 106' and 108' all abut the end 38 of the tap restraining the jaw assembly.

Upon activation of the release means 76, FIG. 1, the pyrotechnic devices 72 and 74 are fired, releasing the upper saddle 24, FIG. 8, permitting the spool 32 and coil 36 combination, FIG. 7, to fly in direction 77 in response to the stored energy in the coil, and permitting the flattened end 38, FIG. 2, to later coil and wrap around the post 16, FIG. 8. The coil unwinds in direction 63, FIG. 7.

With the clamp jaws 94 and 96 encircling the rod 44, FIG. 8, the end 38 of the rod is restrained from bending, expanding, or otherwise opening in the presence of torques on the extended end of the rod produced by wind or other loads in a direction generally normal to axis 20. Thus the clamp assembly 30 provides automatic clamping action responsive to the change in shape of the antenna end 38. It is important to note that the clamp assembly 30 does not interfere with the action of the coil 36 in flying off the lower saddle 22 and unwinding as shown in FIG. 7. Yet the clamp responds to the change in shape of the antenna automatically clamping it when the tape assumes its tubular configuration. Clamp assembly 30 by having different spaced positions in a retracted and extended condition represents an active device as compared to a device such as a ring or bearing which have a fixed spaced relationship with the tubular rod. This change of spaced positions allows the clamp to operate upon a change of state of the tape 34 when it changes shape.

What is claimed is:

1. In a self-erecting antenna comprising a resilient band prestressed to assume the shape of an extended tubular rod when unstressed, the rod having a longitudinal axis parallel to the length dimension of the band, and said band being sufficiently resilient to be flattened and spirally wound into a coil, about an axis parallel to the width dimension of the band, the combination therewith comprising:

means for storing said band, wound into a coil;

a support to which one end of said band is secured;

means for releasing said coil whereby it unwinds and assumes the shape of a tubular rod, the rod being secured at said one end of said band to said support; and movable clamp means responsive to the change in shape of said band when it assumes its tubular rod shape for clamping the peripheral surface of said tubular rod to said support at said one end of said band.

2. The antenna of claim 1 wherein said clamp means includes at least one clamping jaw having a clamped and unclamped state, said clamp means including jaw moving means responsive to the shape of said extended end for moving the jaw from the unclamped to clamped state when the band changes from the flattened to tubular shape.

3. The antenna of claim 1 wherein said support comprises a post to which said one end of said band is secured and which said band encircles when released, and wherein said clamp means comprises pivotal jaw means having retracted and extended positions, said clamp means being responsive to the change of shape of said band and for pivoting and extending said jaw means into clamping engagement with said tubular end at and around said post.

4. The antenna of claim 3 wherein said jaw means includes first and second semicircular jaws, said clamp means including a slidable yoke, means for pivotally securing each of said jaws to said yoke, and means for urging said yoke toward said post, said jaws being positioned with respect to said yoke and said post such that the jaws engage opposite sides of said tubular end when said band assumes said tubular shape.

5. The antenna of claim 4 wherein each jaw includes first and second teeth, both teeth of each jaw engaging the band when said band is wound into a coil, thereby restraining the movement of said yoke, and only one tooth of each jaw engaging said band when the band assumes the shape of a tubular rod, thereby permitting each jaw to pivot, whereby said means for urging moves said yoke and causes said jaws to pivot into engagement with said tubular rod to clamp it to said post at said one end of said band.

6. A collapsible antenna construction comprising:

a spring sheet metal antenna element which tends to return to its free state when in a second restrained deformed state different than the free state, said element when in the free state comprising a tubular rod having a first axis parallel to the length of said element;

housing means releasably restraining said elememt in a coiled state in the form of a flat spiral wound about a second axis parallel to the width of said element;

post means secured to said housing means and to one end of said element, said post means being of a size and orientation such that said element wraps about said post means at said one end of said element when the coiled element is released from said housing means and assumes its free state; and active clamp means abutting said element adjacent said secured end having clamped and unclamped states, said clamp means including means responsive to the element state to clamp said element to said post means only when said element assumes its free state.

7. The construction of claim 6 wherein said housing includes a stationary portion and a releasable cover portion, said coil being adapted to catapult from said stationary portion when said cover portion is released from the stationary portion.

8. The construction of claim 6 wherein said clamp means includes jaw means adjacent said post means and resilient urging means urging said jaws against said element end, said element end being approximately in a flattened condition when coiled and tubular when uncoiled, said jaw means including means responsive to said tubular condition for urging the jaw means around the tubular element and around said post means.

9. The construction of claim 8 wherein said jaw means includes yoke means movably secured to said housing, first and second jaws pivotally secured to the yoke means, each jaw having a base region and a pair of teeth extending from the base region, means for urging said yoke means in a direction toward said post means, said jaws each being pivotally secured to said yoke means at its base region, one tooth of each said pair of teeth lying on a corresponding straight line extending in said direction which passes through said tubular rod, the other of said teeth lying on a line parallel to said straight line spaced from said tubular rod.

10. An antenna construction comprising:

an antenna element comprising a sheet metal resilient strip having a longitudinal axis, said strip being preformed about its longitudinal axis to form a curve about the longitudinal axis so as to assume a tubular shape in cross-section in the absence of external stress on said strip, said strip being sufficiently resilient that it can be placed in a flat state and wound into a spiral coil when in said flat state, the so-wound coil tending to unwind and return to its tubular shape;

a tubular post secured to said strip at one end of the wound coil, the shape and orientation of the post being such that said strip when extended, tends to wrap about said post at said end;

means for releasably restraining the strip wound into said coil, said coil, when released, unwinding and assuming said tubular shape; and clamp means abutting said one end of said coil responsive to the change of shape of said resilient strip at said one end of said coil for clamping the strip at said one end to said post when said coil is released and assumes said tubular shape.

* * * * *